US006701934B2

(12) United States Patent
Schlisio et al.

(10) Patent No.: US 6,701,934 B2
(45) Date of Patent: Mar. 9, 2004

(54) APPARATUS FOR MAKING CIGARETTES WITH COMPOSITE FILTERS

(75) Inventors: Siegfried Schlisio, Geesthacht (DE); Erwin Oesterling, Glinde (DE)

(73) Assignee: Hauni Maschinenbau AG, Hamburg (DE)

( * ) Notice: Subject to any disclaimer, the term of this patent is extended or adjusted under 35 U.S.C. 154(b) by 39 days.

(21) Appl. No.: 10/193,158

(22) Filed: Jul. 12, 2002

(65) Prior Publication Data

US 2002/0174873 A1 Nov. 28, 2002

Related U.S. Application Data

(62) Division of application No. 09/457,863, filed on Dec. 10, 1999, now Pat. No. 6,427,699.

(30) Foreign Application Priority Data

Dec. 10, 1998 (DE) ..... 198 56 934

(51) Int. Cl.[7] ..... A24C 5/47

(52) U.S. Cl. ..... 131/94; 131/282; 131/88; 493/45; 493/47; 493/48

(58) Field of Search ..... 131/94, 282, 88; 493/45, 47, 48, 39

(56) References Cited

U.S. PATENT DOCUMENTS 4,301,816 A 11/1981 Wahle et al.
5,425,383 A 6/1995 Garthaffner et al.
6,427,699 B1 * 8/2002 Schlisio et al. ..... 131/94

OTHER PUBLICATIONS

"Apparatus for Making Filter Cigarettes," Research Disclosure, Mar. 1998, pp. 193–194.

* cited by examiner

*Primary Examiner*—Dionne A. Walls
(74) *Attorney, Agent, or Firm*—Venable LLP; Robert Kinberg; Chad C. Anderson

(57) ABSTRACT

Double-filter cigarettes are produced by inserting different filter components between two rods of tobacco. This is attained by inserting filter components of different final lengths, obtained from separate supplies and processed along separate feed paths, successively between the tobacco rods.

2 Claims, 1 Drawing Sheet

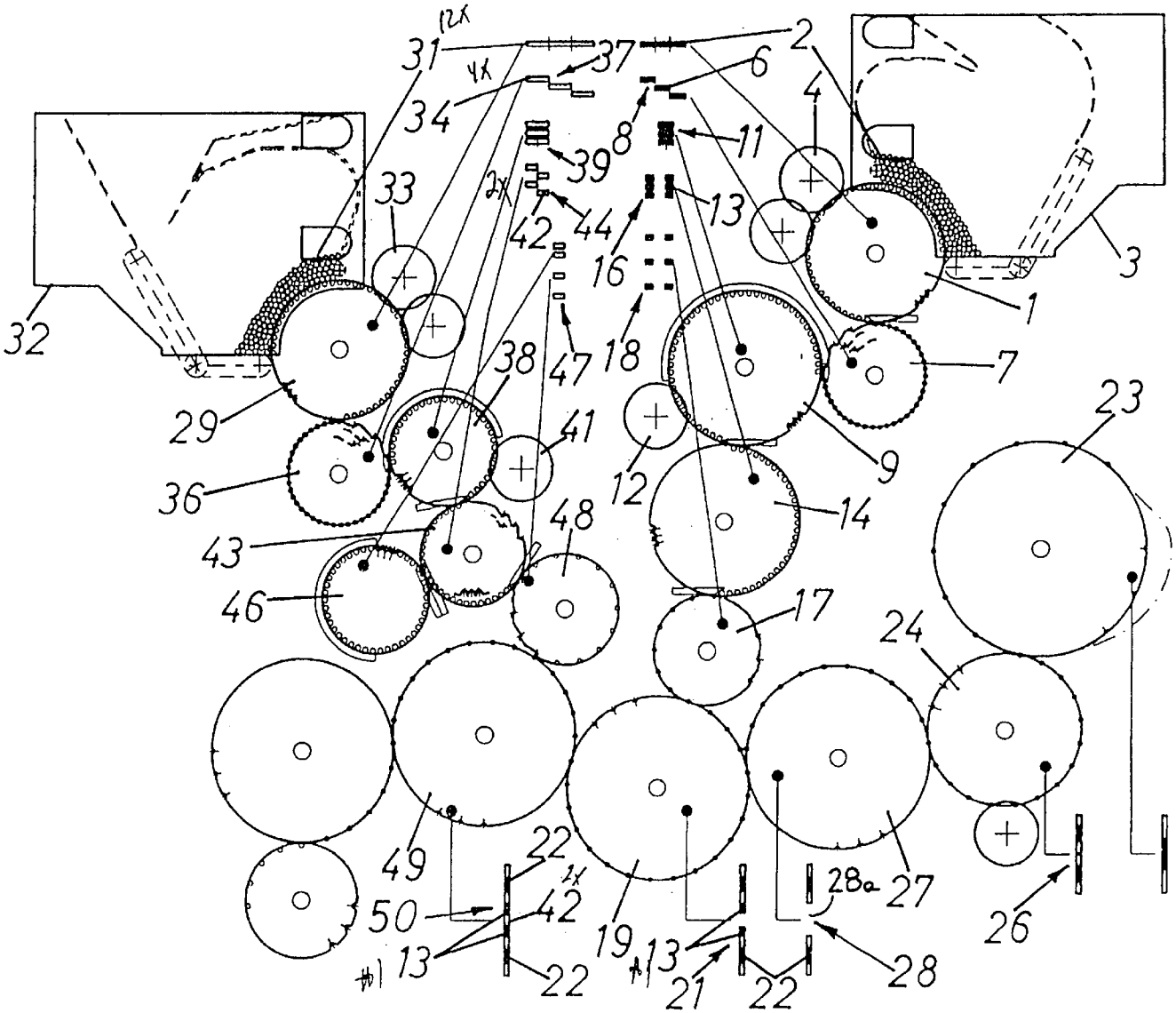
1
2
3
4
6
7
8
9
11
12
13
14
16
17
18
19
22
23
24
26
27
28
28a
29
31
32
33
34
36
37
38
39
41
42
43
44
46
47
48
49
50
12x
4x
2x
1x

APPARATUS FOR MAKING CIGARETTES WITH COMPOSITE FILTERS

CROSS-REFERENCE TO RELATED APPLICATIONS

This application is a divisional of U.S. Ser. No. 09/457,863 filed Dec. 10, 1999 now U.S. Pat. No. 6,427,699 and claims priority with respect to application No. 198 56 934.3 filed in Germany on Dec. 10, 1998, the disclosure of both of the foregoing documents, as well as that of each U.S. and foreign patent and patent application mentioned in the specification of the present application being incorporated herein by reference.

FIELD OF THE INVENTION

The invention relates to a method for producing filter cigarettes with composite filters from different rod-like filter components which are taken from separate supplies, along different feed paths, in lengths that are a multiple of the final lengths, then cut apart into shorter-length portions, and finally inserted between two rods of tobacco oriented co-axially with one another.

The invention also relates to an apparatus for producing filter cigarettes with composite filters from different rod-like filter components, having separate supplies for filter rods that are a multiple times longer than the final length, wherein the filter rods are fed along separate feed paths from the separate supplies, and feed drums are provided for cutting apart, grouping and inserting the rod-like filter components between two tobacco rods oriented co-axially with one another.

BACKGROUND OF THE INVENTION

The term "different filter components" should be understood in terms of the invention to mean filter components of different filter materials, and/or filter segments of different final lengths.

To produce filter cigarettes with combination filters made up of such different filter components by the so-called cross or transverse method, rod-like filter and tobacco articles, before being joined together, are first fed along different paths in a machine unit, via numerous stations in the form of drums whose vertical and horizontal axial spacings determine the size of the machine unit.

SUMMARY OF THE INVENTION

It is an object of the invention to make the requisite work steps for processing and handling different filter components flexible, and to do so at the least possible expense for feed drums.

It is a further object of the invention to optimize the assembly of filter and tobacco components to reduce engineering expense and to improve work procedure.

The above and other objects are accomplished according to one aspect of the invention by the provision of a method for producing filter cigarettes with composite filters from first and second rod-like filter components, comprising: taking the first and second rod-like filter components from respective supplies of the first and second rod-like filter components, along first and second feed paths, respectively, the first and second rod-like filter components each having a length that is a multiple of a final length for a respective one of the first and second rod-like filter components; cutting apart, along the first of the feed paths, the first rod-like filter component into pairs of single-filter plugs; cutting apart, along the second of the feed paths, the second rod-like filter component into a double-length filter plug; and successively inserting the single filter plugs of one of the pairs of single filter plugs and one of the double-length filter plugs between two tobacco rods oriented co-axially with one another.

Thus, according to the invention, rod-like filter components are cut apart, along one feed path, into pairs of single-filter plugs, and on the other feed path, rod-like filter components are cut apart into double-length filter plugs, and the filter plugs of the two filter components are inserted successively between the tobacco rods.

In an advantageous embodiment of the method, a double-length filter plug is inserted centrally between two spaced-apart tobacco rods, leaving a gap relative to each of the adjacent tobacco rods, into which gap single-filter plugs of a pair of filter plugs are subsequently placed. A preferred variant of the invention, conversely, provides that first, pairs of single-filter plugs and then the double-length filter plugs are inserted between the tobacco rods. In yet a further variation, the single-filter plugs are inserted in a position adjacent to the tobacco rods, and the double-length filter plugs are inserted into a central gap between the single-filter plugs. This is especially advantageous for filter components that shed particles while they are being handled, so that the first time they are inserted between the tobacco rods of the sensitive downstream region of the machine unit, in which the components of the articles are glued and wrapped, can be accomplished without soiling, thus allowing long-term functional operation.

The method of the invention is further optimized, in accordance with a refinement of the invention, in that the single-filter plugs are obtained from filter rods with twelve times the final length, and the double-length filter plugs are obtained from filter rods with six times the final length.

According to another aspect of the invention, there is provided an apparatus for producing filter cigarettes with composite filters from different rod-like filter components, comprising: a separate supply for each of the different rod-like filter components, one of the supplies containing filter rods having a length that is six times a final length of filter plugs to be cut the filter rods of the one supply, and a second of the supplies containing filter rods having a length that is twelve times a final length of filter plugs to be cut from the filter rods of the second supply; a separate feed path for feeding filter plugs from a respective one of the supplies, each feed path including feed drums for cutting apart, grouping and inserting the rod-like filter components between two tobacco rods oriented co-axially with one another, wherein one of the feed paths comprises: five feed drums arranged for: (a) making two cuts on each of the filter rods from the one supply to produce intermediate filter rods having twice the final length of filter plugs cut from the filter rods from the one supply; (b) staggering, cross-axially lining up and cutting apart the intermediate filter rods that are twice the final length into single-filter plugs; and (c) longitudinally axially spreading and cross-axially increasing spacing between the single filter plugs for insertion of the single-filter plugs between the two tobacco rods; and wherein the other of the feed paths comprises: six feed drums arranged for (a) making two cuts on each of the filter rods from the second supply to produce first intermediate filter rods that are four times the final length of filter plugs cut from the second supply; (b) staggering, cross-axially lining up and cutting apart the first intermediate filter rods that are four times the final length to produce second intermediate filter rods that are twice the final length of the filter plugs cut from the second supply; and (c) staggering, cross-axial lining up and cross-axial increasing spacing between the second intermediate filter rods for inserting the second intermediate filter rods between the two tobacco rods.

According to a further feature of the apparatus of the invention, there are provided first and second assembly drums and a plurality of feed drums for the tobacco rods lined up with one another and forming a feed path for the tobacco rods, wherein the one feed path comprised of the five feed drums communicates operatively with the feed path of the tobacco rods via the first assembly drum at which the single filter plugs from the one feed path are inserted between tobacco rods delivered to the first assembly drum; and the other feed path, comprised of the six feed drums, communicates operatively with the feed path of the tobacco rods downstream of the first assembly drum via the second assembly drum for inserting the second intermediate filter rods between the tobacco rods.

Because the different filter components are handled strictly in dual lanes until they are inserted between the tobacco rods, conversion of the machine or its adaptation to different filter components and inserting them are made easier. In particular, conversion to a single standard filter component is made simpler by taking the filter delivery drums on one side, that is, the inlet side, out of operation.

Furthermore, filter components that cause intensive soiling, such as charcoal filters, can be kept out of an especially sensitive machine region where there are gluing and wrapping devices.

BRIEF DESCRIPTION OF THE DRAWING

The sole drawing shows a preferred exemplary embodiment of the invention, in terms of a schematic diagram of drums with associated work steps.

DESCRIPTION OF THE PREFERRED EMBODIMENTS

Referring to the FIGURE, there is shown a cutting drum 1 for taking filter rods 2 of a first component (for instance comprising charcoal) with six times the final length from a magazine 3. Filter rods 2 are cut apart by two circular knives 4 into three filter rods 6 that are twice the final length. Filter rods 6 are transferred to a staggering drum 7 where they are changed to a staggered formation 8. From staggering drum 7, staggered filter rods 6 reach a pusher drum 9 in which they are converted into an in-line (in a cross-axial direction) formation 11, and they are then cut apart once again by a circular blade 12 into single-length filter plugs 13. Filter plugs 13 are converted by a spreader drum 14 into a spread-apart formation 16 in which a greater spacing between ends is established between each two filter plugs 13 of one pair, and finally in this formation they are transferred to an acceleration drum 17, on which the filter plugs 13 are put into a formation 18 with increased cross-axial spacing.

From the acceleration drum 17, filter plugs 13, which are spaced apart in both the axial and cross-axial directions, are inserted directly, on an assembly drum 19 from both sides, into an insertion position 21 in a gap 28*a* between two tobacco rods 22. Tobacco rods 22 are delivered by a drum 23 with twice the final length, cut through the center on a cutting drum 24 as indicated by the cutting position 26, and longitudinally-axially spread apart on a spreading drum 27 as indicated by the spreading position 28.

Filter rods 31 of a second component, with 12 times the final length, are taken by a cutting drum 29 from a magazine 32, cut apart by two circular knives 33 into three intermediate filter rods 34, each having four times the final length, transferred to a staggering drum 36, and converted on it into a staggered formation 37. From staggering drum 36, staggered intermediate filter rods 34 reach a pusher drum 38 on which they are converted into an in-line (in the cross-axial direction) formation 39 and are again cut apart by a circular knife 41 into second intermediate filter rods 42 with twice the final length. Cut-apart second intermediate filter rods 42 are again put into a staggered formation 44. by a staggering drum 43. For ease of illustration, staggered formation 44 only shows two, instead of three, pair of intermediate cut-apart filter rods 42. Second intermediate filter rods 42 are put in an inline formation 47 on a pusher drum 46 and are returned to staggering drum 43. The cross-axially spaced-apart, second intermediate filter rods 42 are inserted, by an acceleration drum 48, on an assembly drum 49 centrally into the gap between the two filter plugs 13 as indicated by the insertion position 50. The tobacco and filter rod combination 13, 22, 42 of twice the final length, which is created in the insertion position 50, is then further conveyed, for example, by unnumbered drums shown to the left of assembly drum 49 in the FIGURE for being fabricated in a known manner into single filter cigarettes by cutting the double-length, second intermediate filter rods 42 through the center by means not illustrated.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention

What is claimed is:

1. An apparatus for producing filter cigarettes with composite filters from different rod-like filter components, comprising:

a separate supply for each of the different rod-like filter components, one of the supplies containing filter rods having a length that is six times a final length of filter plugs to be cut the filter rods of the one supply, and a second of the supplies containing filter rods having a length that is twelve times a final length of filter plugs to be cut from the filter rods of the second supply;

a separate feed path for feeding filter plugs from a respective one of the supplies, each feed path including feed drums for cutting apart, grouping and inserting the rod-like filter components between two tobacco rods oriented coaxially with one another, wherein one of the feed paths comprises:

five feed drums arranged for: (a) making two cuts on each of the filter rods from the one supply to produce intermediate filter rods having twice the final length of filter plugs cut from the filter rods from the one supply, (b) staggering, cross-axially lining up and cutting apart the intermediate filter rods that are twice the final length into single-filter plugs, and (c) longitudinally axially spreading and cross-axially increasing spacing between the single filter plugs for insertion of the single-filter plugs between the two tobacco rods; and wherein the another of the feed paths comprises:

six feed drums arranged for (a) making two cuts on each of the filter rods from the second supply to produce first intermediate filter rods that are four times the final length of filter plugs cut from the second supply, (b) staggering, cross-axially lining up and cutting apart the first intermediate filter rods that are four times the final length to produce second intermediate filter rods that are twice the final length of the filter plugs cut from the second supply, and (c) staggering, cross-axial lining up and cross-axial increasing spacing between the second intermediate filter rods for inserting the second intermediate filter rods between the two tobacco rods.

2. The apparatus of claim 1, further comprising first and second assembly drums and a plurality of feed drums lined up with one another and forming a feed path for the tobacco rods, wherein the one feed path comprised of the five feed drums communicates operatively with the feed path of the tobacco rods via the first assembly drum at which the single filter plugs from the one feed path are inserted between tobacco rods delivered to the first assembly drum; and the other feed path, comprised of the six feed drums, communicates operatively with the feed path of the tobacco rods downstream of the first assembly drum via the second assembly drum for inserting the second intermediate filter rods between the tobacco rods.

* * * * *